US007325707B2

(12) United States Patent
Bougamont et al.

(10) Patent No.: US 7,325,707 B2
(45) Date of Patent: Feb. 5, 2008

(54) DISPENSER FOR A LIQUID OR PASTY PRODUCT

(75) Inventors: Jean-Louis Bougamont, Eu (FR); Astrid Henquenet, Cannessieres (FR)

(73) Assignee: Rexam Dispensing Systems S.A.S. (FR)

( * ) Notice: Subject to any disclaimer, the term of this patent is extended or adjusted under 35 U.S.C. 154(b) by 401 days.

(21) Appl. No.: 11/086,086

(22) Filed: Mar. 22, 2005

(65) Prior Publication Data

US 2005/0242127 A1 Nov. 3, 2005

Related U.S. Application Data

(63) Continuation of application No. PCT/FR03/02699, filed on Sep. 12, 2003.

(30) Foreign Application Priority Data

Sep. 13, 2002 (FR) ..... 02 11417

(51) Int. Cl.
*B67D 5/42* (2006.01)

(52) U.S. Cl. ..... 222/390; 222/413

(58) Field of Classification Search ..... 222/390, 222/271, 412, 413, 489, 584; A45D 34/04; B05C 17/01
See application file for complete search history.

(56) References Cited

U.S. PATENT DOCUMENTS

| | | | |
|---|---|---|---|
| 2,738,905 A | 3/1956 | Olson | |
| 2,926,818 A | 3/1960 | Spero | |
| 5,524,795 A | 6/1996 | Lee | 222/207 |

FOREIGN PATENT DOCUMENTS

| | | |
|---|---|---|
| DE | 1 934 416 | 1/1970 |
| FR | 2 670 755 | 6/1992 |
| FR | 2 807 631 | 10/2001 |

OTHER PUBLICATIONS

International Search Report; Feb. 6, 2004.

*Primary Examiner*—Lien M. Ngo
(74) *Attorney, Agent, or Firm*—St. Onge Steward Johnston & Reens LLC

(57) ABSTRACT

The invention relates to a liquid or pasty product dispenser comprising a mounted working piston. According to the invention, the dispenser comprises a hollow body with a piston mounted therein and a toothed wheel is connected to the piston by means of threads, said piston being blocked in rotation in the body. In this way, when the toothed wheel is actuated, the piston moves axially and the product is dispensed in a controlled manner. Preferably, an outlet-sealing needle valve passes through the piston.

18 Claims, 3 Drawing Sheets

FIG.1
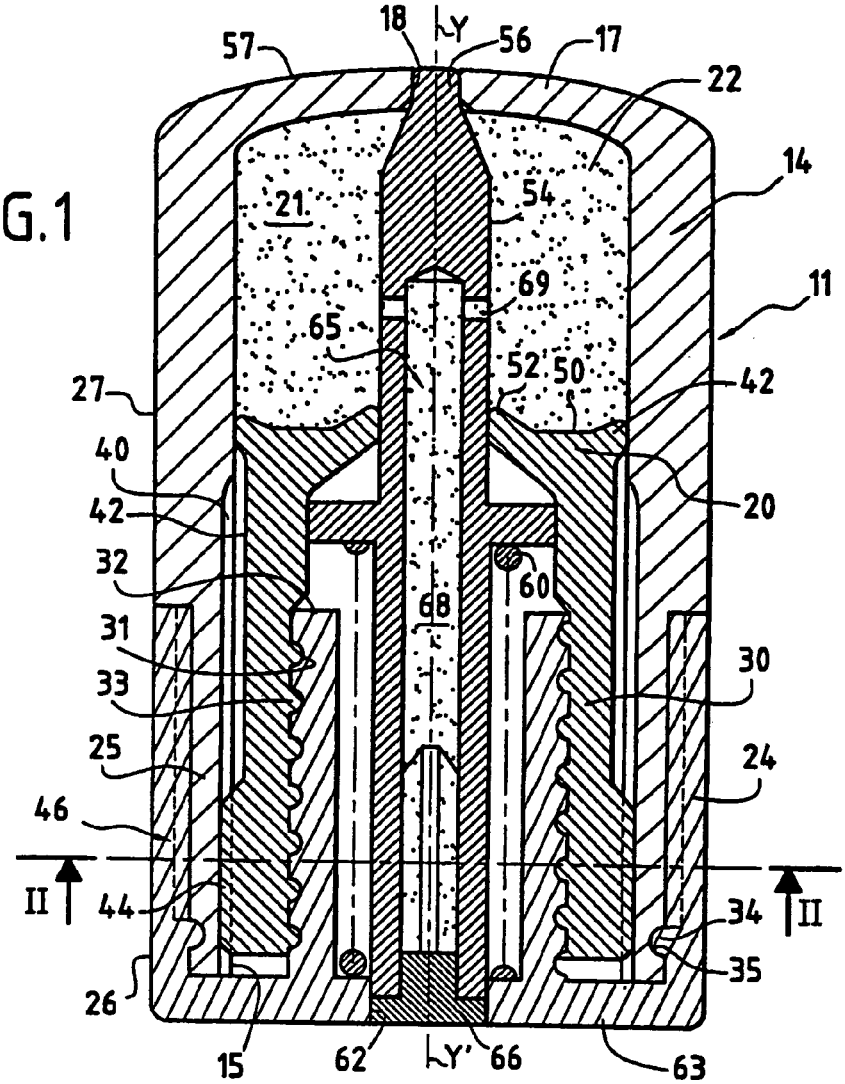
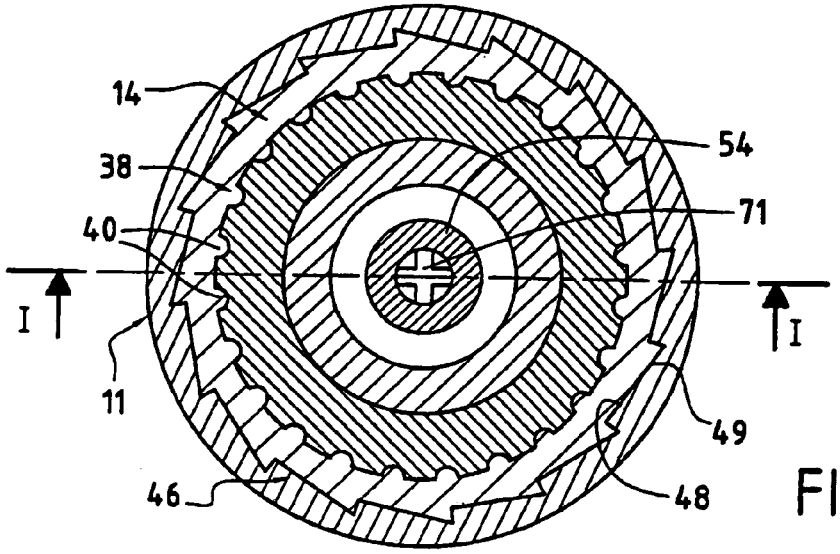
FIG.2

DISPENSER FOR A LIQUID OR PASTY PRODUCT

This application is a continuation of pending International Patent Application No. PCT/FR2003/002699 filed Sep. 12, 2003, which designates the United States and claims priority of French Patent Application No. 02/11417 filed Sep. 13, 2002.

FIELD OF THE INVENTION

The invention relates to a dispenser for a liquid or pasty product, in which the product is extracted by controlled displacement of a piston within a body, the assembly defining a chamber containing such a product.

Dispensers for thick liquid or pasty products are known which comprise a generally cylindrical body and a piston which can be displaced in the body and forms a movable wall of a chamber containing the product. An extraction mechanism, in communication with the chamber, comprises a pump designed to draw in and dispense a predetermined dose upon each actuation. The piston is simply a follower, its displacement being determined by the amount of product extracted. The volume of the chamber decreases by adapting to the amount of product which remains. In such a device, the pump is located between the chamber and an ejection nozzle or the like, so that product may dry and/or become impaired in the ejection tube and the pump. Moreover, a known device of this type comprises a large number of relatively fragile parts, in particular those which form the pump, which results in an expensive packaging for a reliability which is sometimes mediocre.

The invention makes it possible to overcome these drawbacks.

One object of the invention is to propose a dispenser for a liquid product, in which the product is dispensed by direct action on the piston, without a pump having to be integrated therein.

More particularly, the invention relates to a dispenser for a liquid or pasty product, comprising a hollow body and a piston which is mounted for sealed displacement within said body and delimits with said body a chamber for the product to be dispensed, an outlet channel being defined in an end wall of said body, characterized in that it comprises a toothed wheel mounted to rotate with respect to said body at one end of the latter, in that a rotation blocking arrangement is defined between said body and said piston, in that said piston has a hollow skirt with an internal thread, in that said toothed wheel comprises an inner cylindrical part which is engaged in said hollow skirt, and in that this cylindrical part has an external thread and is screwed into said hollow skirt.

Another object of the invention is to propose a dispenser of the type defined above which additionally comprises means for metering the amount of product extracted.

According to one possible embodiment, non-return means are defined between the toothed wheel and the body so as to allow rotation of the toothed wheel in just one direction with respect to said body. This arrangement makes it possible per se to control the travel of the piston and consequently to allow metering of a certain amount, proportional to the rotation of the toothed wheel.

According to a more particularly advantageous embodiment, the dispenser defined above is characterized in that, said toothed wheel and/or said body being made of a relatively deformable plastic material, said non-return means comprise sawtooth ribs which are defined on two generally cylindrical facing parts of said body and said toothed wheel and are engaged in one another.

In this way, the user can easily control the travel of the piston, notch by notch. By judiciously selecting the plastic materials used to form said body and said toothed wheel, it is possible to make the actuation of the non-return means relatively audible, forming a clicking movement system. This allows the user to count the number of clicks so as to control the amount of product dispensed.

In one simple embodiment, the dispenser for a liquid or pasty product has the overall shape of a rod comprising an orifice provided on the face of the end wall thereof. The product is dispensed via this orifice. The latter is preferably located in the center of said end wall so that the dose of product dispensed accumulates on the latter. The product can be removed using a finger, for example in order to apply it if it is a cosmetic product. In other cases, the dispenser may have an applicator at its end, the shape and structure of which applicator are adapted to the intended use of the product.

According to another advantageous feature, the dispenser is characterized in that a needle is mounted to slide in a sealed manner through said piston and in line with the internal orifice of said outlet channel, in that it is elastically biased toward said outlet channel, and in that the end of said needle is shaped and dimensioned so as to engage in said outlet channel and close off the latter.

This needle therefore makes it possible to effectively isolate the chamber when the dispenser is not in use, which improves preservation of the product.

In one advantageous embodiment, the outlet channel is formed by an axial rectilinear hole which passes through said end wall, and the needle comprises an end which is shaped and dimensioned so as to close off said hole essentially up to the outer face of the end wall of said body. All ends are thus sealed and no dried product residue can form downstream of the needle in the outlet channel since the volume of the latter, which has been reduced to a minimum, is occupied by the needle itself.

According to another advantageous feature, the needle exhibits a reduction in cross section in said chamber. By this simple means, the needle is retracted automatically under the effect of an increase in pressure in the chamber, that is to say when the toothed wheel is actuated. For example, the needle may be biased into the closed position by a spring fitted in said hollow skirt between a shoulder of the needle and the toothed wheel. In this way, the needle is retracted and frees the outlet channel as soon as the pressure in the chamber is great enough to subject said needle to a force greater than the force exerted by the spring.

Moreover, since the coupling between the toothed wheel and the piston is irreversible, the dispenser is provided so as to be filled via the dispensing channel, when the chamber is at its maximum volume, that is to say with the piston as far away from the end wall of the body as possible. The design of the needle advantageously promotes the discharge of air during filling of the dispenser.

To this end, an air discharge channel, which can be closed off, is defined in said needle. This discharge channel comprises an axial section which opens to the rear of the needle, while a stopper is engaged in this axial section from behind. The stopper is released from behind the needle during filling so as to allow the discharge of air and is definitively pushed in at the end of the filling phase.

The invention also relates to a method of filling a dispenser as described above, characterized in that it consists, said chamber being at its maximum volume, in keeping said air discharge channel in communication with the atmosphere, in filling said chamber by injecting said product under pressure through said outlet channel, and in reclosing the air discharge channel when said chamber is full of product.

BRIEF DESCRIPTION OF DRAWINGS

The invention will be better understood and other advantages of the invention will become more clearly apparent in the light of the following description of a dispenser for a liquid or pasty product in accordance with its principle, which description is given solely by way of example and with reference to the appended drawings, in which:

FIG. 1 is a view in elevation, along a section I-I of FIG. 2, of a dispenser according to the invention;

FIG. 2 is a section II-II of FIG. 1;

DETAILED DESCRIPTION OF DRAWINGS

Figure 3:
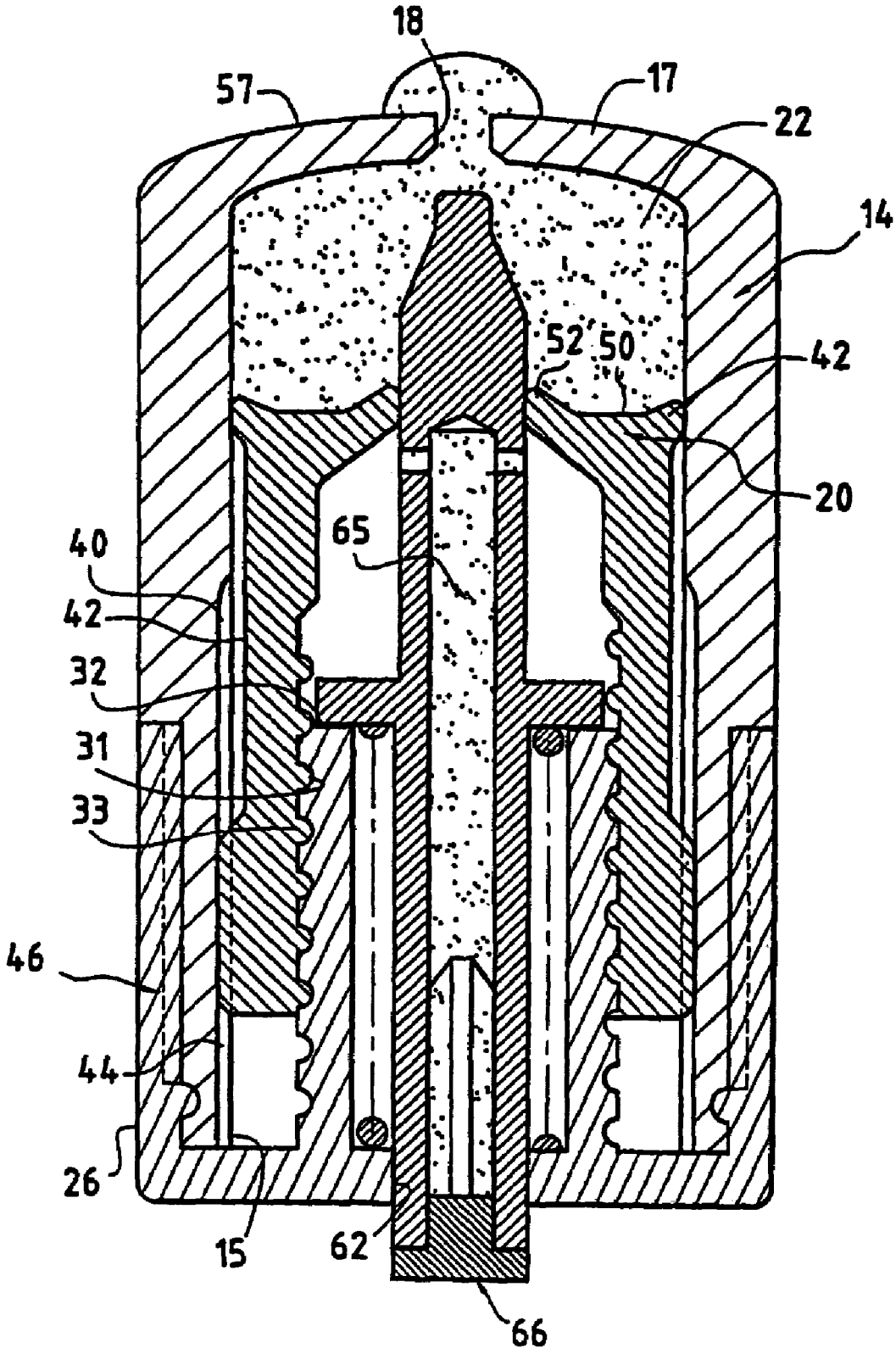
FIG. 3 is a view similar to FIG. 1, showing the device as a dose of product is being dispensed.

The dispenser for a liquid or pasty product 11, as shown, comprises a hollow body 14 which is generally cylindrical and comprises an open end 15 and an end wall 17 at the opposite end, which end wall has an outlet channel 18 formed by an axial rectilinear hole which passes through this wall 17. A piston 20 is mounted for sealed displacement within the body. In the rest of the description, any mention of an axial direction or of an axis refers to the general axis of symmetry YY' of the dispenser, which coincides with that of the piston and of the channel 18. The piston and the body define between them a variable-volume chamber 21 containing the product 22 to be dispensed. The dispenser also comprises a toothed wheel 24 mounted to rotate with respect to the body at the open end 15 of the latter. The body of the dispenser comprises two longitudinally adjacent parts of different diameter. In the example, this difference in diameter is obtained by a reduction in wall thickness of said body over a section 25 of the latter starting from the open end. The toothed wheel 24, which in this case has a generally cylindrical shape, is mounted in the thinner part of the body of the dispenser so that its outer side wall 26 is generally located in the continuation of the outer side wall 27 of the rest of the body 14. The piston 20 has a hollow skirt 30 with an internal thread (thread 31). The toothed wheel comprises an inner cylindrical part 32 which is engaged in the hollow skirt 30 of the piston. The inner cylindrical part of the toothed wheel has an external thread (thread 33) and is screwed into the hollow skirt. The toothed wheel 24 and the body are immobilized in terms of axial translation with respect to one another by a bead/groove assembly. In the example, the bead 34 is defined on the inner face of an outer skirt forming the toothed wheel, while the groove 35 is defined on a cylindrical part of the body, close to the open end 15 of the latter. Moreover, a rotation blocking arrangement 38 is defined between said body and said piston. In the example shown, the rotation blocking arrangement comprises at least one and preferably several ribs 40 which extend parallel to the longitudinal axis of the device and are defined on the inner face of said body 14. Furthermore, the piston 20 is made of a relatively flexible plastic material so that the ribs 40 leave their imprints therein in order to prevent rotation of the piston with respect to said body. There is therefore no need to provide, by molding, any grooves on the surface of the outer cylindrical wall of the piston, on account of the soft material used to form the latter; mounting of the piston is facilitated. The end of the piston 20 located next to the chamber 21 is shaped with a peripheral sealing lip 42 which is in sealed and "scraping" contact with the inner cylindrical wall of the body. The ribs 40 are made in an inner portion of the body which has an increased diameter, adjoining the part with a smooth wall which defines the chamber 21, 50 that said ribs cannot enter into contact with the sealing lip defined on the periphery of the active face of the piston when the piston is mounted. The skirt 30 of the piston itself comprises a portion 42 of reduced cross section which extends over a distance at least equal to the travel of the piston, between the lip 42 and a portion 44 of large cross section which cooperates with the ribs 40.

As described up to now, the dispenser makes it possible to meter at least approximately the amount of product dispensed upon each use, in particular if care is taken to inscribe graduations along two neighboring circular lines borne respectively by the body and the toothed wheel. This is because it is clear that the amount of product discharged depends directly on the angle at which the toothed wheel is turned with respect to the body.

Nevertheless, in order to make the metering more precise, non-return means 46 are defined between the toothed wheel 24 and the body 14 so as to allow rotation of the toothed wheel in just one direction with respect to said body.

In the example shown, the toothed wheel and the body are made of relatively deformable plastic materials. Under these conditions, according to one advantageous embodiment, said non-return means 46 consist of notched ribs having the profile of opposing sawteeth 48, 49, which lie opposite one another and are defined respectively on two generally cylindrical facing parts of the body and the toothed wheel. As can clearly be seen in FIG. 2, these ribs are engaged in one another. Each rib has a face which extends in an essentially radial direction. These radial faces, which belong respectively to the outer surface of the body and to the inner surface of the toothed wheel, abut against one another in pairs and prevent any rotation in one direction. The other faces of said ribs are almost tangential so that, with a slight radial deformation of the toothed wheel and possibly of part of said body, rotation in the other direction is possible, with a gradual progression which is advantageously audible. The rotation of the toothed wheel with respect to the body, in this favored direction, brings about the longitudinal displacement of the piston, each "notch" corresponding to a predetermined amount of dispensed product.

Moreover, the central part of the active face 50 of the piston 20 is hollowed out and shaped with an inner lip 52 in sealed contact with the cylindrical side wall of a needle 54 mounted axially in the dispenser, in line with the internal orifice of the outlet channel 18. The needle is elastically biased toward the outlet channel. Its end is shaped and dimensioned so as to engage in said outlet channel. In the example, the outlet channel 18 is formed by an axial rectilinear hole of small length which passes through the end wall of the body, and said needle comprises an end portion 56 which is shaped and dimensioned so as to close off said hole essentially up to the outer face 57 of the end wall of the body. In the example, the end portion 56 is cylindrical. Complete closure of the dispenser "at all ends" is thus obtained, preventing any drying of residual product. Moreover, the needle exhibits a reduction in cross section in the chamber, that is to say a reduction in diameter between the cylindrical part against which the piston slides and that 56 which closes off the outlet channel. In this way, an increase in pressure in the chamber 21 gives rise to an axial force on the needle 54 which tends to move it away from the end wall of the body. Moreover, a spring 60 is fitted in a pre-compressed manner in the hollow skirt of the piston between a shoulder of the needle and the toothed wheel 24. The end of the needle opposite that which controls the outlet channel engages and slides in a central hole 62 in the bottom 63 of the toothed wheel, which closes off the open end 15 of the body.

The mode of operation of the device as described up to now is extremely simple. When the user wishes to extract a certain amount of product, all the user has to do is turn the toothed wheel 24 with respect to the body 14 in the only permitted direction. Since the piston is immobilized in terms of rotation in the body, and since the toothed wheel is connected to the piston by way of the thread, this gives rise to an axial displacement of the piston which is strictly proportional to the angle of rotation of the toothed wheel. If it is assumed that the chamber is completely full of product, without any inclusion of air, actuation of the piston immediately brings about an increase in pressure in said chamber 21, which on account of the shape of the needle brings about axial retraction of the latter, thereby freeing the outlet channel 18. Consequently, a predetermined dose of product (FIG. 3) accumulates on the outer face 57 of the wall of the body. This amount is greater or smaller depending on the rotation of the toothed wheel, which can be controlled by counting the number of "notches". The user can then remove the product emerging outside the end face of the body using a finger. At the end of the rotation, the pressure inside the chamber decreases and the needle 54 returns to its place under the action of the spring 60.

As shown in the drawing, the body 14 and the toothed wheel 24 are advantageously two elements which are generally cylindrical and are arranged in the continuation of one another so as to form a generally cylindrical unit. The dispenser as described may form a standardized functional unit which forms a type of "motor" able to receive a casing, the shape of which is representative of the product offered. For example, this casing may consist of two parts, one covering essentially the body and the other covering the toothed wheel, these two parts having a shape which need not necessarily be cylindrical. It would be possible to select a casing having facets parallel to the axis of rotation and defining, in cross section, a polygonal contour. Such a shape per se allows visual metering (even in the absence of notched ribs between the body and the toothed wheel) by the simple fact that a rotation between two positions where the lateral faces of the body and of the toothed wheel come into alignment with one another is per se an indication of the dose. In this context, it is also possible to provide an inverse unidirectional stop between the toothed wheel and its casing so as to allow reverse movement and alignment of the lateral faces after use without of course causing any retraction of the piston.

Returning to the structure of the dispenser 11 per se, it should be noted that the needle 54 is advantageously suitable for discharging air at the time of filling of the chamber. This is because the dispenser must be filled by positioning the piston so that the chamber 21 is at its maximum volume, as shown in FIG. 1, since the pressure at which the product is injected would be insufficient to push the piston back, given its mode of coupling via a thread to the toothed wheel. It is therefore necessary to be able to discharge the air during the filling operation. For this reason, an air discharge channel 65, which can be closed off by a stopper 66, is defined in the needle in order to allow the chamber to be filled. This air discharge channel comprises an axial section 68 which is connected to the chamber by radial bores 69 and opens axially to the rear of the needle. The stopper 66 is engaged in this axial section from behind. The stopper 66 comprises a solid end part 70 extended by fins 71 which are engaged in the axial section. In this way, the stopper can be partially engaged in the axial section and remain in a selected position by virtue of the friction forces developed in particular between the fins 71 and the inner wall of this axial section. In the position shown in FIG. 4, that is to say before and during the filling operation, the stopper is semi-engaged in the axial section so that the air can escape freely between the chamber and the outside. Optionally, the needle 56 can be maneuvered if necessary, by way of the stopper which is semi-engaged, since the friction forces developed between the fins and the needle are greater than the force exerted by the spring. By contrast, once the chamber is completely full of product, the stopper is pushed as far as possible into the axial section (FIG. 3) and the air discharge channel is definitively closed off.

Figure 4:
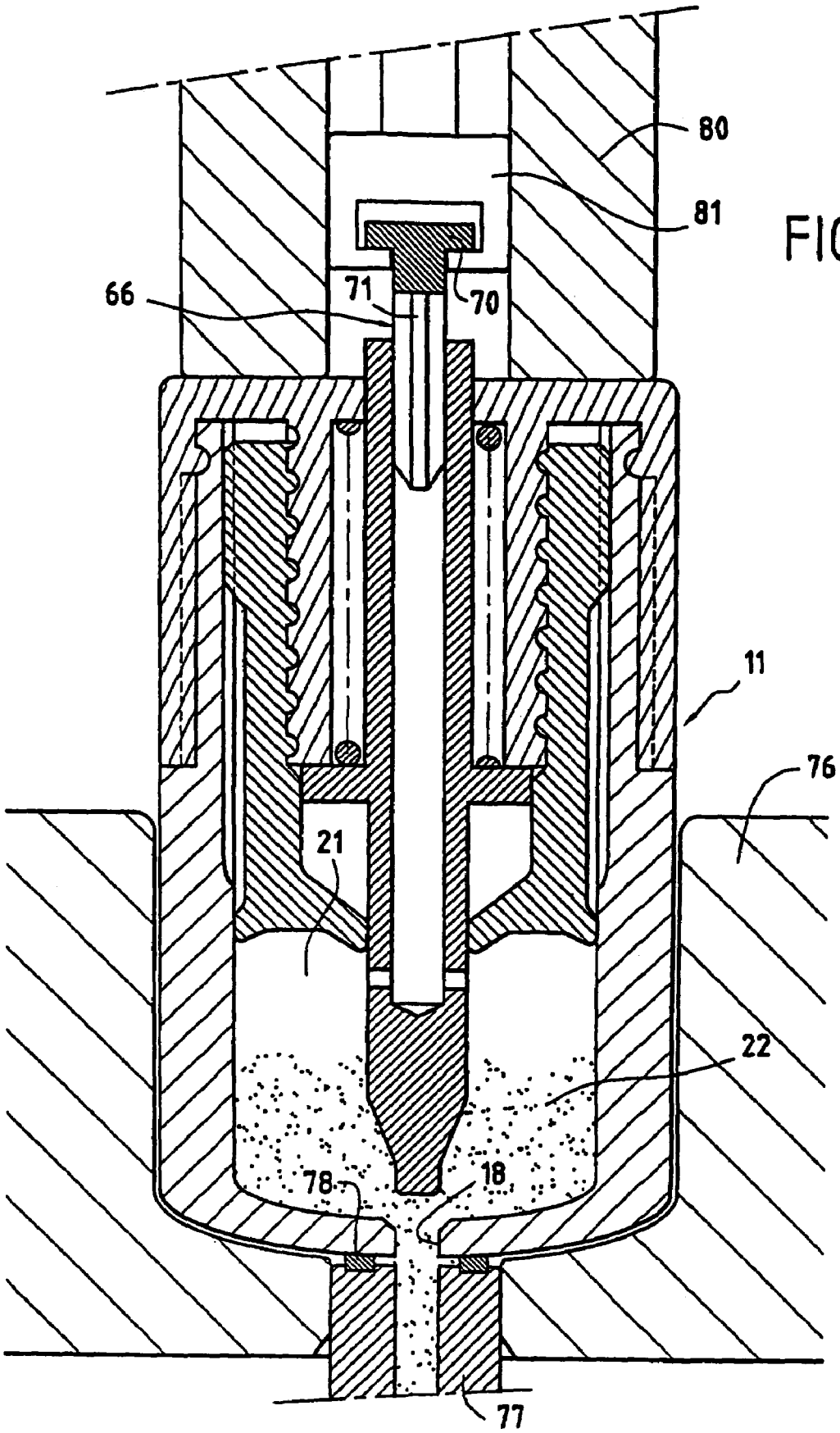
FIG. 4 shows the device being filled.

FIG. 4 shows the filling process. The dispenser, which is empty and with the stopper semi-engaged, is positioned "upside down" in one of the cavities of a locating device 76, the base of which has a tubular filling nozzle 77 equipped with a seal 78 which comes to bear around the orifice of the outlet channel 18. The product is injected under pressure through the filling nozzle and thus penetrates into the chamber via the outlet channel. Filling takes place when the cavity of the locating device in which the empty dispenser is situated arrives opposite an upper stop 80 which immobilizes the dispenser in the locating device, which allows the filling nozzle to be pressed in a sealed manner around the outlet channel. Optionally, the upper stop may be equipped with a traction fork 81 which is shaped so as to grip the stopper by its solid part 70, which comprises a collar. This fork is connected to a ram (not shown) so that the needle can be positively retracted at the time of filling. It should be noted that this arrangement is not absolutely necessary if the pressure at which the product is injected is sufficient to raise the needle. In any case, at the time of filling, with the chamber being at its maximum volume, the air discharge channel is kept in communication with the atmosphere and the chamber is filled with product by injecting said product under pressure through the outlet channel, as shown in FIG. 4. The filling method is brought to an end by pushing the stopper back in as far as it will go once the dispenser 11 has been released from the stop 80.

What is claimed is:

1. A dispenser for a liquid or pasty product, comprising a hollow body and a piston which is mounted for sealed displacement within said body and delimits with said body a chamber for the product to be dispensed, an outlet channel being defined in an end wall of said body, characterized in that it comprises a toothed wheel mounted to rotate with respect to said body at one end of the latter, in that a rotation blocking arrangement is defined between said body and said piston, in that said piston has a hollow skirt with an internal thread, in that said toothed wheel comprises an inner cylindrical part which is engaged in said hollow skirt, and in that this cylindrical part has an external thread and is screwed into said hollow skirt, and further characterized in that a needle is mounted to slide in a sealed manner through said piston and in line with the internal orifice of said outlet channel, in that it is elastically biased toward said outlet channel, and in that the end of said needle is shaped and dimensioned so as to engage in said outlet channel and close off the latter.

2. The dispenser as claimed in claim 1, characterized in that it comprises means for metering the amount of product extracted.

3. The dispenser as claimed in claim 1, characterized in that non-return means are defined between the toothed wheel and the body so as to allow rotation of the toothed wheel in just one direction with respect to said body.

4. The dispenser as claimed in claim 3, characterized in that, said toothed wheel and/or said body being made of a relatively deformable plastic material, said non-return means comprise sawtooth ribs which are defined on two generally cylindrical facing parts of said body and said toothed wheel and are engaged in one another.

5. The dispenser as claimed in claim 1, characterized in that said toothed wheel and said body are immobilized in terms of translation with respect to one another by a bead/groove assembly, said bead and said groove being defined on two generally cylindrical facing parts of the body and the toothed wheel.

6. The dispenser as claimed in claim 1, characterized in that said rotation blocking arrangement comprises at least one rib defined on the inner face of said body and extending parallel to the axis of displacement of said piston.

7. The dispenser as claimed in claim 6, characterized in that said ribs are made in an inner portion of said body which has an increased diameter.

8. The dispenser as claimed in claim 6, characterized in that said piston is made of a relatively flexible plastic material so that the or each rib of said body leaves its imprint therein in order to bring about the immobilization in terms of rotation of said piston with respect to said body.

9. The dispenser as claimed in claim 1, characterized in that said outlet channel is formed by an axial rectilinear hole which passes through said end wall, and in that said needle comprises an end portion which is shaped and dimensioned so as to close off said hole essentially up to the outer face of said end wall of said body.

10. The dispenser as claimed in claim 9, characterized in that said needle exhibits a reduction in cross section in said chamber.

11. The dispenser as claimed in claim 1, characterized in that a spring is fitted in a pre-compressed manner in said hollow skirt between a shoulder of said needle and said toothed wheel.

12. The dispenser as claimed in claim 1, characterized in that an air discharge channel, which can be closed off, is defined in said needle in order to fill the chamber.

13. The dispenser as claimed in claim 12, characterized in that said air discharge channel comprises an axial section which opens to the rear of the needle, and in that a stopper is engaged in this axial section from behind.

14. The dispenser as claimed in claim 1, characterized in that said body and said toothed wheel are two elements which are generally cylindrical and are arranged in the continuation of one another.

15. A method of filling a dispenser as claimed in claim 12, wherein said chamber is at its maximum volume, and wherein said method comprises the steps of:

keeping said air discharge channel in communication with the atmosphere, filling said chamber by injecting product under pressure through said outlet channel, and reclosing the air discharge channel when said chamber is full.

16. A dispenser for a liquid or pasty product, comprising a hollow body and a piston which is mounted for sealed displacement within said body and delimits with said body a chamber for the product to be dispensed, an outlet channel being defined in an end wall of said body, characterized in that it comprises a toothed wheel mounted to rotate with respect to said body at one end of the latter, in that a rotation blocking arrangement is defined between said body and said piston, in that said piston has a hollow skirt with an internal thread, in that said toothed wheel comprises an inner cylindrical part which is engaged in said hollow skirt, and in that this cylindrical part has an external thread and is screwed into said hollow skirt, and further characterized in that non-return means are defined between the toothed wheel and the body so as to allow rotation of the toothed wheel in just one direction with respect to said body.

17. The dispenser as claimed in claim 16, characterized in that, said toothed wheel and/or said body being made of a relatively deformable plastic material, said non-return means comprise sawtooth ribs which are defined on two generally cylindrical facing parts of said body and said toothed wheel and are engaged in one another.

18. A dispenser for a liquid or pasty product, comprising a hollow body and a piston which is mounted for sealed displacement within said body and delimits with said body a chamber for the product to be dispensed, an outlet channel being defined in an end wall of said body, characterized in that it comprises a toothed wheel mounted to rotate with respect to said body at one end of the latter, in that a rotation blocking arrangement is defined between said body and said piston, in that said piston has a hollow skirt with an internal thread, in that said toothed wheel comprises an inner cylindrical part which is engaged in said hollow skirt, and in that this cylindrical part has an external thread and is screwed into said hollow skirt, further characterized in that said rotation blocking arrangement comprises at least one rib defined on the inner face of said body and extending parallel to the axis of displacement of said piston, and further characterized in that said piston is made of a relatively flexible plastic material so that the or each rib of said body leaves its imprint therein in order to bring about the immobilization in terms of rotation of said piston with respect to said body.

* * * * *